United States Patent [19]

LeBoeuf et al.

[11] Patent Number: 4,633,953

[45] Date of Patent: Jan. 6, 1987

[54] METHOD FOR OFFSHORE PRODUCTION OF HYDROCARBONS CONCURRENTLY WITH THE INSTALLATION OF A STRUCTURE THEREFOR

[75] Inventors: Harry P. LeBoeuf, Morgan City; Allen J. Verret; Paul D. Broussard, both of Berwick, all of La.

[73] Assignee: Texaco Inc., White Plains, N.Y.

[21] Appl. No.: 633,747

[22] Filed: Jul. 23, 1984

[51] Int. Cl.[4] ..... E21B 7/136; E21B 43/017

[52] U.S. Cl. ..... 166/358; 166/366; 175/9; 405/204; 405/211

[58] Field of Search ..... 166/366, 365, 362, 335, 166/339, 341, 358; 175/7, 9, 10, 8; 405/204, 224, 195, 203, 211

[56] References Cited

U.S. PATENT DOCUMENTS

| | | | |
|---|---|---|---|
| 3,430,695 | 3/1969 | Hubbard | 175/7 |
| 3,618,661 | 11/1971 | Peterman | 166/366 |
| 4,192,383 | 3/1980 | Kirkland et al. | 166/366 |
| 4,231,682 | 11/1980 | Tuson | 166/366 |
| 4,249,618 | 2/1981 | Lamy | 175/9 |
| 4,283,159 | 8/1981 | Johnson et al. | 405/211 |
| 4,286,665 | 9/1981 | Walker | 166/366 |
| 4,438,817 | 3/1984 | Pokladnick et al. | 166/366 |
| 4,492,270 | 1/1985 | Horton | 405/204 |

*Primary Examiner*—Stephen J. Novosad
*Assistant Examiner*—Bruce M. Kisliuk
*Attorney, Agent, or Firm*—Robert A. Kulason; James J. O'Loughlin; Robert B. Burns

[57] ABSTRACT

A method is provided for producing usable hydrocarbon product from an offshore reservoir. The method includes the economically desirable step of producing a valuable hydrocarbon product from the formation, soon after its being discovered. The product is then extracted from its reservoir, long prior to, and during the period when a marine structure is being fabricated and installed to more fully develop the reservoir and to receive a flow of the product.

7 Claims, 5 Drawing Figures

METHOD FOR OFFSHORE PRODUCTION OF HYDROCARBONS CONCURRENTLY WITH THE INSTALLATION OF A STRUCTURE THEREFOR

BACKGROUND OF THE INVENTION

In any offshore discovery of a hydrocarbon containing reservoir such as one holding crude oil and/or gas, a considerable time elapses between the actual time of discovery and the date when a flow of usable hydrocarbon is realized. The primary causes of delay are the necessary factors that go into preparing the site and the equipment so that wells can be drilled and the product extracted from the reservoir.

Essentially, the reservoir or the formation and its environment must be tested to determine the condition of the soil, and as near as possible the conditions at the hydrocarbon formation or reservoir. Thereafter, and with this material in hand, a marine structure can be designed to be installed at the offshore site. The usual structure is capable of holding equipment for drilling the necessary wells and handling the resulting flow of product from these wells.

An essential facet of any such structure or platform is the presence of drill conductors which function to guide a drill string as well as to form a conduit for drilling fluids. Said conductors normally comprise a series of tubular members which are incorporated into the offshore structure as it is being constructed. Under some circumstances the conductors can be driven into the formation by the drilling rig or vessel.

Frequently, the marine structure is provided with a series of vertically aligned and spaced apart conductor guides. Thereafter, when a well is to be drilled, a conductor is lowered through the respective guides to assure a generally vertical disposition in anticipation of a drill string being passed therethrough.

The design and building of an appropriate offshore structure is contingent to a large extent on the availability of facilities where the structure will be fabricated. This often requires that a reservation be made months in advance for use of said facilities in order to commence the physical building of the structure.

Thereafter, when the structure has been completed, it is installed by being either floated to its offshore site, or by being barged. When it is properly positioned, it is fixed in place. With the structure's basic jacket located and piled, the remainder of the platform can be completed. The latter includes the positioning of well drilling equipment which is arranged cooperatively with pre-set drill conductors so that the necessary wells can be drilled.

In any event the time schedule for the above noted design, building, installation and ultimate operation of the platform can extend into several years.

During this extended period the reservoir or productive subterranean formation will remain untapped and serve no useful purpose.

The herein disclosed method provides means whereby the offshore hydrocarbon containing formation or reservoir can be tapped or provided with a number of producing wells within a relatively limited time period. While at least some of the wells are thereafter provisionally producing usable product, the support structure can be designed, built and subsequently installed to facilitate further drilling and production.

The disclosed offshore structure is thus adapted to utilize an auxiliary drilling vessel or ship to commence the production process. This however will be a temporary expedient until drilling equipment on the permanent platform can be utilized.

The method herein disclosed resides in the use of a composite marine structure that can be built and installed on a piecemeal basis. This avoids the usual time delay which would otherwise result were the productive field or hydrocarbon containing formation to be provided with a drilling and producing structure in the usual manner.

Physically, a relatively simple drilling template is fabricated which includes a plurality of upright drilling conductors. The function of the latter is to extend downwardly into the ocean floor, and upward for a predetermined distance beyond the water's surface. In such a position they will receive a downwardly moving, rotating drill string such that the latter can penetrate the substrate and concurrently confine a flow of drilling mud.

In any platform utilized for offshore drilling, normally a drilling conductor is inserted into a platform slot only at such times as it is to be used. Thus, and as noted herein, the structure is provided with a series of vertically spaced drilling conductor guides which serve to properly position the conductor as it is lowered from the deck down toward the ocean floor.

As a well is drilled through a prepositioned conductor, the well is subsequently completed, provided with well head equipment, and turned into a producing facility.

In the present arrangement, a provisionally placed drilling vessel is utilized in conjunction with the initially installed drilling template. This is achieved by positioning or anchoring the vessel adjacent to the template. Thereafter, the vessel such as a jack-up rig which is provided with an overhung or outboard drilling platform, can extend over the installed template. The vessel's drilling equipment will thus be in position to penetrate the ocean floor by way of one of the conductors.

Following this procedure, one or more wells can be drilled through a plurality of conductors, at least some of which wells can be producers. These will be connected to the shore or preferably to fluid separating equipment. The latter function to separate the liquid and gaseous products before each is transferred to shore or to a storage facility.

Eventually, the above noted marine structure will be completed at the fabrication yard such that it can be installed in conjunction with the preinstalled drilling template. The platform, following normal design, will include a drilling deck having facilities thereon for continuing the drilling of the wells through the remaining conductors. Thus, the need for the auxiliary drilling vessel will be lessened, even obviated and the further drilling of wells can proceed from the platform itself.

It is therefore an object of the invention to provide a method for facilitating the extraction of hydrocarbon products from an offshore formation in a manner which will permit rapid realization of a usable product without the immediate need for use of an expensive drilling and producing structure.

A further object is to provide means for extracting a hydrocarbon fluid from an offshore reservoir or formation on a provisional basis during the interim period when the permanent marine structure or platform jacket is being fabricated and installed.

Producing hydrocarbons from an offshore subterranean reservoir or formation initially necessitates that corings be taken and tests be made to determine the composition of the substrate and the parameters of the productive area. This is achieved through a number of methods known to the prior art and exercised widely by the petroleum industry.

When an approximate definition and scope of the reservoir has been determined, and the depth of water is known, a suitable drilling template can be designed and fabricated.

Figure 1:
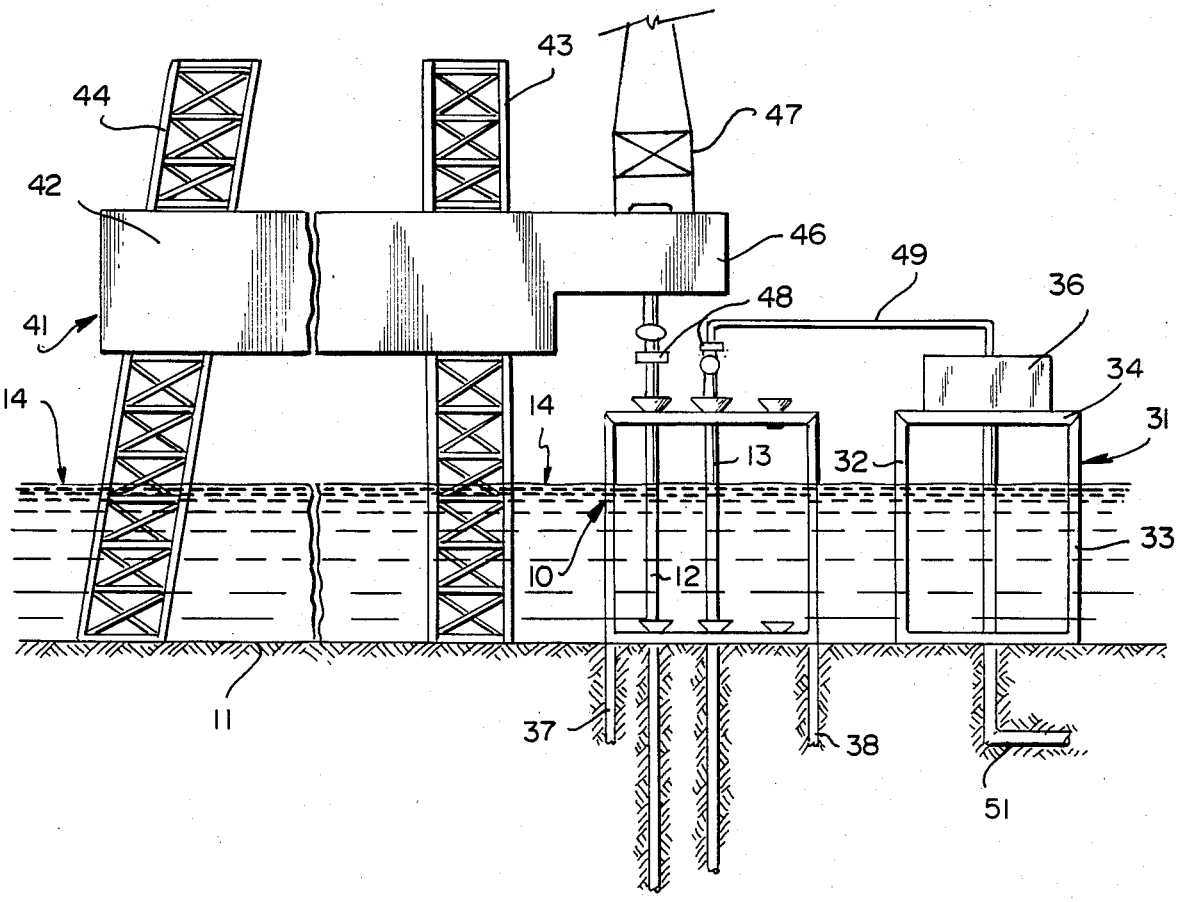
FIG. 1 is an elevation view of an offshore installation of the type contemplated for carrying out the method.
Figure 2:
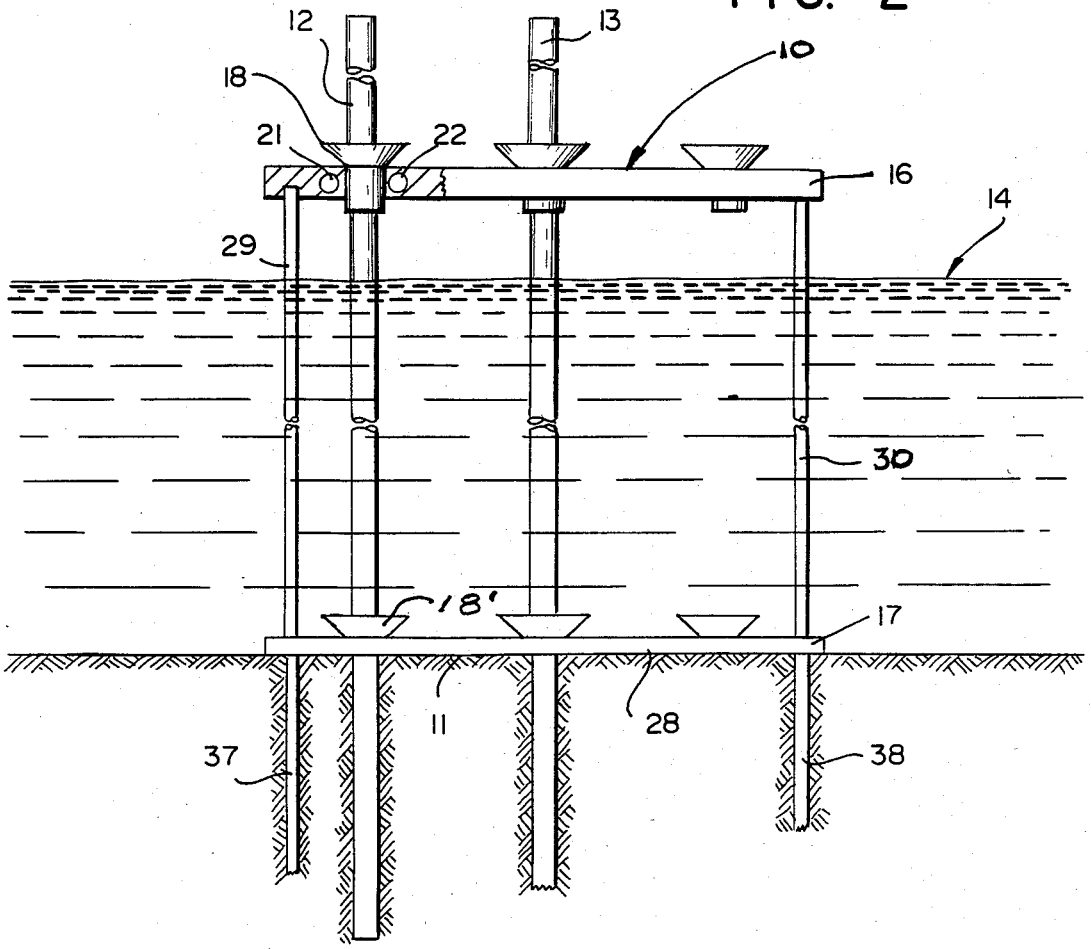
FIG. 2 is a segmented view of FIG. 1 showing the drilling template.
Figure 3:
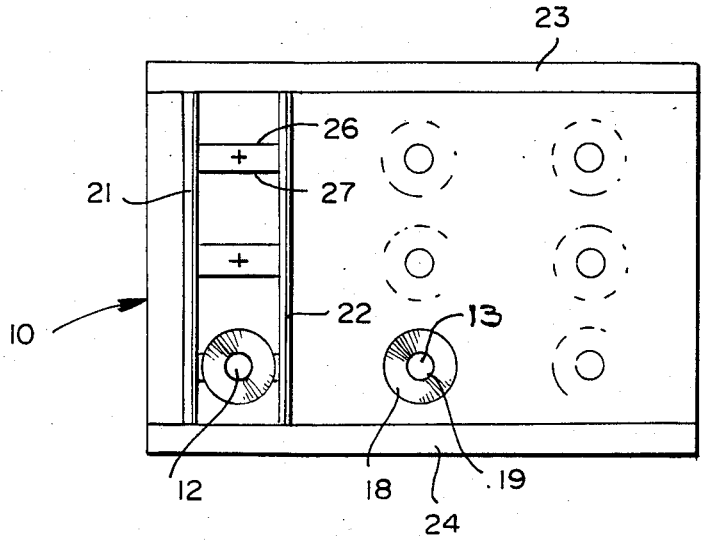
FIG. 3 is a top view of FIG. 2.

Referring to FIGS. 1, 2 and 3, a drilling template 10 of the type contemplated is designed to fasten to the ocean floor 11 and to accommodate a number of drill conductors 12 and 13. The latter will extend above the water's surface 14 to be accessible for a drill string to be registered therein to drill a well. Normally the conductor is held substantially vertical, with its lower end buried in the formation 11.

As shown in FIGS. 2 and 3, drilling template 10 comprises primarily vertically spaced apart upper tier 16 and lower tier 17. Each of the levels includes a plurality of conductor guides 18 and 18' which generally assume a wide mouth conical configuration. Thus, a downcoming conductor 12 will be directed through the guide center opening 19 and be aligned with the next lower guide 18'.

While only two levels or tiers are here shown, it is understood that drilling template 10 can embody any number of vertically spaced apart tiers depending on water depth. Each tier, however, will include a series of aligned conductor guides capable of guiding, and supporting a conductor in an upright position prior to a drilling operation.

Drilling template upper tier 16 is comprised of a set of transverse stringers 21 and 22 which terminate at spaced apart terminal members 23 and 24. Corresponding braces 26 and 27 extend between adjacent stringers, each pair forming a support seal for a conical guide element 18. The latter includes, as noted, a central passage 19 which is capable of slidably registering a downwardly moving tubular drilling conductor.

Drilling template 10 lower level 17 is comprised of a base 28 having a series of conductor guides 18' which correspond to the arrangement of the guides in upper tier 16. Base 28 further includes corner columns 29 and 30 which extend between the upper and lower levels. These columns can be embedded into substrate 11 a limited distance or they can accommodate anchoring piles when the drilling template 10 is set into place at a drilling site.

Normally, upper and lower level conductor guides 18 and 18' respectively, are disposed in substantial vertical alignment. However, in the instance of the need to drill one or more diverted wells, the respective guides can be offset one from the other. This arrangement causes a downwardly moving conductor to be bent to assume a predetermined progressive curvature.

Referring to FIG. 1, to facilitate movement of produced hydrocarbon from the various wells formed in the respective conductors 12 and 13, a second structure 31 is embedded adjacent to the drilling template 10. Said second structure includes a plurality of downwardly extending legs 32 and 33 which support a deck 34. The latter is provided with processing means 36 to receive one or more flows of produced hydrocarbon fluid. Here the fluid can be separated into components prior to transporting the hydrocarbon either as gas or liquid to the shore, to a tanker, or to other storage means.

After drilling template 10 has been properly positioned and fastened into place with piles 37 and 38 to maintain its stability, it is ready to receive a drill string from an adjacent drilling vessel 41. The latter can be comprised of any one of a number of drilling ships or vessels familiar to the industry. These include both floaters and floor anchored platforms.

In the present arrangement, drilling vessel 41 comprises a jack-up type rig wherein a deck 42 holds the necessary drilling and operating equipment for an offshore site. The vessel is provided with a plurality of operably positioned support legs 43 and 44. Deck 42 in effect comprises a hull which permits it to be floated into position for a drilling operation as desired.

When properly positioned, the respective support legs 43 and 44 are urged downwardly through deck 42 until they contact the floor 11. Thereafter the deck elevating mechanism is activated to climb up the respective legs to a predetermined height above the water level. Deck 42 can now be utilized for drilling purposes in conjunction with template 10.

In the present arrangement, the drilling vessel deck 42 includes an outboard drilling platform 46 which is positioned to extend from one side of the vessel's hull 42. It can thereby overlie drilling template 10 in contemplation of a drilling operation. As here shown, drilling platform 46 is provided with the usual equipment for achieving a drilling operation. Such equipment usually comprises a derrick 47, a rotary table, necessary mud circulating pumps, draw works and the like. Said equipment is carried in a manner to permit a drill string to be lowered through the drilling platform 46 and into waiting conductor 12.

As the drilling operation proceeds, eventually the hydrocarbon productive substrate will be reached and the well will be completed to include the usual well head, flow control equipment 48. The latter is operable to regulate the outflow of hydrocarbon fluid whether it be crude oil, gas or a combination thereof. As each well is completed, drilling platform 46 and derrick 47 are adjusted to be in alignment with another conductor in the template 10 and the drilling operation proceeds.

As each well is completed, it will be connected by conduits 49 to processing means 36 on the adjacent structure 31. The latter usually comprises a manifold platform on which the various segments of processing and storage equipment are carried to receive produced product. Thus, the processed hydrocarbon, after leaving said equipment 36, can be moved by pipeline 51 to the shore, or alternately loaded onto an adjacent tanker to be carried away.

During the period between the commencement of the various wells and the subsequent flowing of hydrocarbon product, the permanent enclosing jacket 52 and platform can be designed and built. This latter segment will then be cooperatively placed about drilling template 10 and manifold platform 31.

Figure 4:
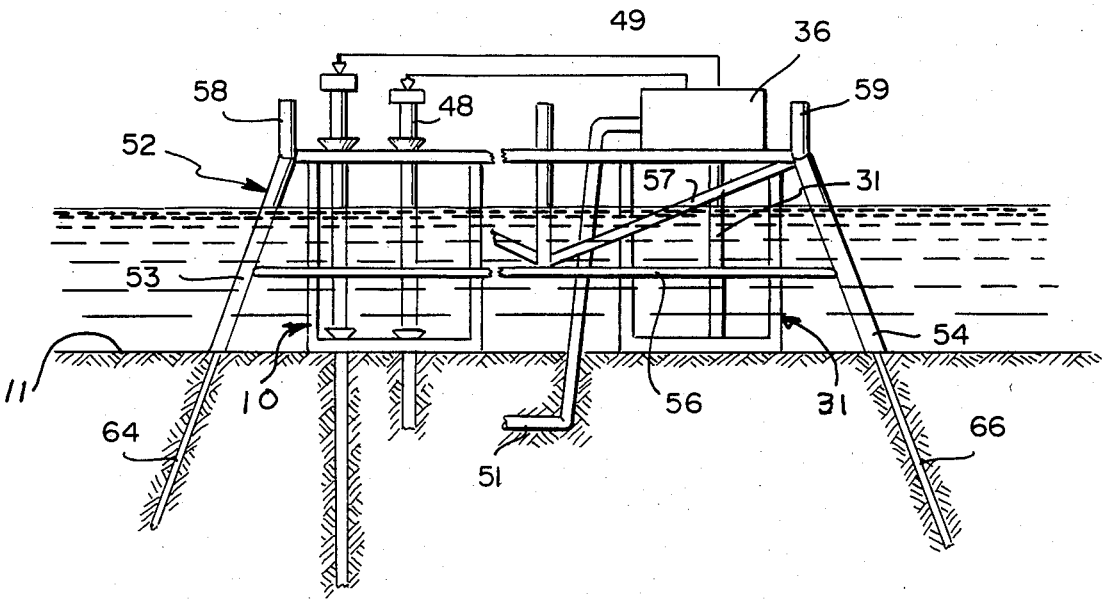
FIGS. 4 and 5 are similar to FIG. 1.

Referring to FIG. 4, an offshore platform of the type herein contemplated is comprised primarily of jacket 52 which is comprised of a plurality of upstanding or battered legs 53 and 54 which extend from a point above the water's surface, downward to the ocean floor 11. The respective support legs are connected with intermittent braces 56 and 57 to give the unit structural integrity.

To lower the completed jacket 52 into position, it is necessary to suspend the drilling operation through drilling template 10. This is followed by a retraction of legs 43 and 44 on drilling vessel 41 so that the latter can be floated on its hull 42 and removed.

Jacket 52, which can be shipped by barge or floated to the drilling site, can now be readied to be guidably placed about drilling template 10. It is thus lifted with the aid of a crane and lowered about both drilling template 10 and the manifold platform 31 to assure a protective barrier and support means about these preinstalled members.

Figure 5:
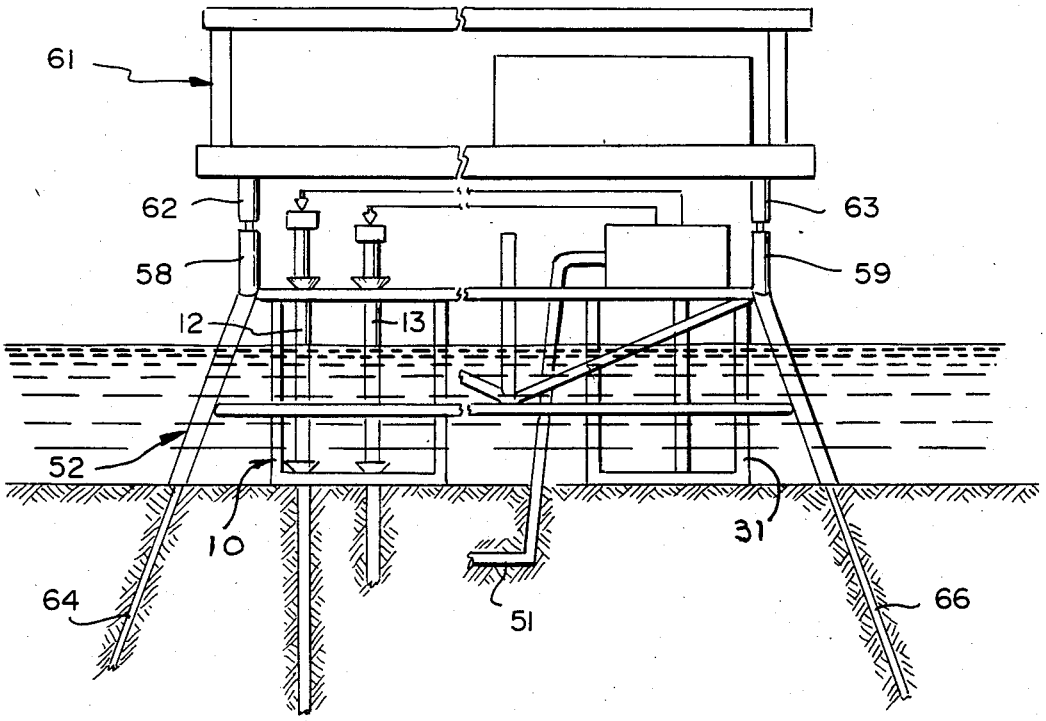

As shown in FIG. 5, after jacket 52 is piled into place it is provided with means to align and receive an operating deck 61 on the jacket upper side. Jacket 52 is thus provided with a series of upstanding posts 58 and 59 into which corresponding deck columns 62 and 63 can be stabbed whereby to properly align and engage the supporting jacket to the deck.

Jacket 52 can be fastened to the ocean floor by pilings 64 and 66 or by similar means. The latter is achieved directly, by registering one or more piles 64 and 66, through a leg such as 53. Alternately, exterior piles which connect to a leg's outer surface can be utilized as the anchoring mechanism.

With the enclosing jacket 52 and operating deck 61 fully installed, additional producing wells can be drilled and the production received on processing equipment carried on said deck. Thereafter, any equipment which was provisionally installed on manifold structure 31 can be disconnected and removed.

Although modifications and variations of the invention can be made without departing from the spirit and scope thereof, only such limitations should be imposed as are indicated in the appended claims.

We claim:

1. Method for producing hydrocarbon fluids from at least one hydrocarbon producing well formed in a subterranean hydrocarbon containing formation beneath an offshore body of water, which method includes the steps of;

installing a drilling template at the floor of said offshore body of water, said drilling template including at least one upstanding drill conductor which extends from said ocean floor to an elevation beyond the ocean's surface, installing a second structure at the floor of said offshore body of water adjacent to said installed drilling template, said second structure including hydrocarbon fluid processing equipment, and communicating said at least one hydrocarbon producing well with said processing equipment, removably positioning a drilling vessel having an outboard drilling platform adjacent to said drilling template, such that said outboard drilling platform overlies the drilling template and is in vertical alignment with said at least one upstanding drill conductor, completing at least one well into said formation from said overlying drilling platform through said at least one drill conductor, producing hydrocarbon fluid flow from said at least one completed well, displacing said drilling vessel from its position adjacent to the drilling template, guidably positioning a protective jacket having an operating deck about said drilling template, while maintaining production of the hydrocarbon fluid flow from said at least one completed well, and drilling further wells into said formation from drilling equipment on said operating deck, through other drill conductors in said drilling template.

2. In the method as defined in claim 1, wherein said jacket is guidably positioned to enclose the drilling template as well as the said second structure adjacent thereto and piling said jacket to the floor beneath said offshore body of water.

3. In the method as defined in claim 1, wherein said secondarily installed structure's fluid processing equipment is progressively communicated with the respective wells completed through said upstanding drill conductors.

4. In the method as defined in claim 1, including the step of; installing additional drill conductors into said drilling template spaced from said at least one conductor, to drill additional wells therethrough.

5. In the method as defined in claim 1, wherein said protective jacket and said operating deck are sequentially positioned about said drilling template.

6. In the method as defined in claim 1, wherein the respective protective jacket and operating deck each include guide means positioned to be engaged for bringing the operating deck in proper alignment with the drilling template.

7. In the method as defined in claim 1, wherein the protective jacket and the operating deck each include means for assembling said respective members into vertical alignment with the drilling template.

* * * * *